US007256162B2

(12) United States Patent
Pollock et al.

(10) Patent No.: US 7,256,162 B2
(45) Date of Patent: Aug. 14, 2007

(54) FATTY ACID ESTERS AND USES THEREOF

(75) Inventors: Charley M. Pollock, Savannah, GA (US); Lloyd A. Nelson, Savannah, GA (US)

(73) Assignee: Arizona Chemical Company, Jacksonville, FL (US)

( * ) Notice: Subject to any disclaimer, the term of this patent is extended or adjusted under 35 U.S.C. 154(b) by 6 days.

(21) Appl. No.: 10/672,430

(22) Filed: Sep. 26, 2003

(65) Prior Publication Data

US 2005/0075254 A1 Apr. 7, 2005

(51) Int. Cl.
*C10M 129/74* (2006.01)
*C10L 1/18* (2006.01)

(52) U.S. Cl. ..... 508/455; 508/486; 508/501; 44/386; 44/400

(58) Field of Classification Search ..... 560/129, 560/103, 102, 121, 128; 508/455; 44/386
See application file for complete search history.

(56) References Cited

U.S. PATENT DOCUMENTS

| | | | | | |
|---|---|---|---|---|---|
| 1,815,022 | A | | 7/1931 | Davis | |
| 2,015,748 | A | | 10/1935 | Frolick | |
| 2,191,498 | A | | 2/1940 | Reiff | |
| 2,384,501 | A | | 10/1945 | Dietrich | |
| 2,655,479 | A | | 10/1953 | Mundy et al. | |
| 2,666,746 | A | | 1/1954 | Munday et al. | |
| 2,721,877 | A | | 10/1955 | Popkin et al. | |
| 2,721,878 | A | | 10/1955 | Popkin | |
| 2,875,221 | A | | 2/1959 | Birnbaum | |
| 3,250,715 | A | | 5/1966 | Wyman | |
| 3,493,534 | A | * | 2/1970 | Coury et al. | 528/196 |
| 3,549,570 | A | * | 12/1970 | Coury | 528/176 |
| 3,595,888 | A | | 7/1971 | Reiser et al. | |
| 3,769,215 | A | * | 10/1973 | Sturwold et al. | 508/494 |
| 4,683,069 | A | | 7/1987 | Brewster et al. | |
| 4,713,188 | A | | 12/1987 | Wollenberg | |
| 4,957,651 | A | | 9/1990 | Schwind | |
| 5,064,546 | A | * | 11/1991 | Dasai | 508/436 |
| 5,114,603 | A | | 5/1992 | Kennedy et al. | |
| 5,132,399 | A | * | 7/1992 | MacDonald et al. | 530/208 |
| 5,176,956 | A | * | 1/1993 | Jevne et al. | 600/391 |
| 5,543,110 | A | * | 8/1996 | Starr et al. | 422/5 |
| 5,744,432 | A | * | 4/1998 | Barnhorst et al. | 508/431 |
| 5,866,520 | A | | 2/1999 | Addagarla et al. | |
| 5,885,942 | A | | 3/1999 | Zhang et al. | |
| 5,886,128 | A | * | 3/1999 | West et al. | 528/158.5 |
| 6,069,119 | A | * | 5/2000 | Robinson et al. | 508/449 |
| 6,129,772 | A | * | 10/2000 | Weers et al. | 44/385 |
| 6,187,903 | B1 | * | 2/2001 | Elsasser et al. | 530/230 |
| 6,806,235 | B1 | * | 10/2004 | Mueller et al. | 507/138 |
| 6,875,842 | B2 | * | 4/2005 | Fontana | 530/210 |

FOREIGN PATENT DOCUMENTS

| | | |
|---|---|---|
| JP | 5-25108 | 2/1993 |
| JP | 6-128193 | 5/1994 |
| WO | WO-89/06683 | 7/1989 |
| WO | WO-01/72933 | 10/2001 |

OTHER PUBLICATIONS

"Fuel efficient lubricant formulations for passenger cars or heavy duty trucks" Benard, Francois, Espinoux, Federic; Bourgognon, Henri; Lamy, Bernard; SAE Special Publication.

* cited by examiner

*Primary Examiner*—Ellen M. McAvoy
(74) *Attorney, Agent, or Firm*—Joseph W. Segers, III.; J. M. (Mark) Gilbreth; Deborah C. Segers

(57) ABSTRACT

Esters formed from polyol, $C_{12}$-$C_{28}$ branched chain fatty acid, and/or $C_{12}$-$C_{28}$ cyclic fatty acid are useful as a friction modifier for lubricants. Monomer is a preferred source for these fatty acids.

43 Claims, No Drawings

FATTY ACID ESTERS AND USES THEREOF

BACKGROUND OF THE INVENTION

1. Field of the Invention

The present invention is directed to polyol esters. This invention also relates to the use of these esters in fuels, oils and lubricant packages for engines and in metal working fluids, where the esters enhance the performance properties of the composition.

2. Description of the Related Art

Glycerol monooleate (GMO) is well known to function as a friction modifier in lubricant compositions for engines. See, e.g., U.S. Pat. Nos. 5,885,942; 5,866,520; 5,114,603; 4,957,651; and 4,683,069, which are exemplary only. Indeed, GMO enjoys considerable commercial success, and is sold by a number of companies, for example, American Ingredients Company, Patco Additives Division, Kansas City, Mich., USA; Ivanhoe Industries, Unichema (Netherlands) and Mundelein, Ill., USA; Stepan Company, Northfield, Ill., USA.

There is a need in the art for a friction modifier that has superior properties compared to GMO, and which provides an improved cost performance ratio. The present invention meets this need and provides further related advantages as described herein.

BRIEF SUMMARY OF THE INVENTION

In separate aspects, the present invention provides polyol Monomerate, polyol monoMonomerate, and a composition comprising polyol monoMonomerate and polyol diMonomerate. In each aspect, the polyol may be, for instance, glycerol.

In another aspect, the present invention provides a composition comprising a first component selected from the group consisting of monoester of polyol and Monomer, diester of polyol and Monomer, and triester of polyol and Monomer, and a second component selected from the group consisting of monoester of polyol and Monomer, diester of polyol and Monomer, triester of polyol and Monomer, polyol, and Monomer; where the first and second components are non-identical. In this composition, in one embodiment, the polyol is glycerol.

The present invention also provides a composition comprising the esterification product of a) Monomer or a reactive equivalent thereof; and b) polyol or a reactive equivalent thereof. The polyol may be, for instance, glycerol.

In another aspect, the present invention provides a composition comprising the esterification product of a) a $C_{12}$-$C_{28}$ cyclic fatty acid or reactive equivalent thereof; b) a $C_{12}$-$C_{28}$ branched fatty acid or reactive equivalent thereof; and c) one or more polyols or reactive equivalent(s) thereof. The polyol(s) may be, for instance, glycerol and/or pentaerythritol. Optionally, each of the $C_{12}$-$C_{28}$ cyclic fatty acid and the $C_{12}$-$C_{28}$ branched fatty acid is present in Monomer.

In another aspect, the present invention provides a composition comprising a first ester selected from

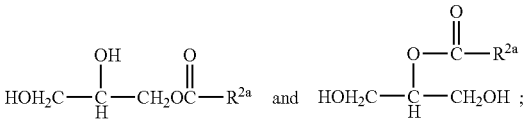

and a second ester selected from

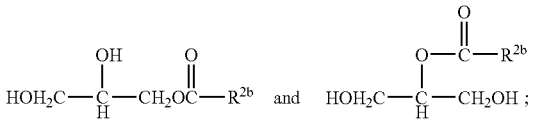

wherein $R^{2a}$ is a branched $C_{12}$-$C_{28}$ hydrocarbon and $R^{2b}$ is a cyclic $C_{12}$-$C_{28}$ hydrocarbon. In a preferred embodiment, $R^1$—COOH and $R^2$—COOH are present in Monomer.

In additional aspects, the present invention provides a fuel composition comprising a distillate fuel having a sulfur content less than 0.05% by weight and from an ester or composition (or both) as described herein. Analogously, the present invention provides a method for improving the lubricity of a distillate fuel having a sulfur content of less than 0.05% by weight, comprising the addition thereto of the ester or ester composition as described herein. The ester or composition is present in the fuel composition in an amount effective to enhance the lubricity of the fuel, i.e., a composition of base fuel and ester of the present invention displays superior lubricity properties compared to the base fuel in the absence of the ester of the present invention. This effective amount is typically 1 to 10,000 ppm of ester. The fuel may be, and in one aspect of the invention is, a diesel fuel. Other suitable fuels include jet fuel and gasoline. In one aspect, the ester is polyol Monomerate. In additional aspects, the present invention provides lubricant composition comprising an lubricating base fluid as classified in Groups I to V by American Petroleum Institute (API) and adopted by the lubricant industry and an ester or ester-containing composition of the present invention. Analogously, the present invention also provides a method of improving the friction properties of a lubricating base fluid comprising adding an ester or ester-containing composition of the present invention to lubricating base fluid. In the preferred embodiments of the invention the lubricating fluid is a lubricating oil, an industrial oil, e.g., a power transmission fluid or a hydraulic fluid or a lubricating fluid used in metal working fluids, e.g._fluids used for cutting, grinding, and stamping metals. These and related aspects of the present invention are described in further detail below.

DETAILED DESCRIPTION OF THE INVENTION

The present invention is directed to polyol esters, and particularly to polyol ester blends where one member of the blend is formed from a branched chain fatty acid and a second member of the blend is formed from a cyclic fatty acid. Such blends are readily prepared using Monomer as the source of fatty acids. Before further discussion of this and other aspects of the present invention, a brief discussion of Monomer and its origin will be provided.

The Kraft wood pulping process, also known as the sulfate pulping process, produces tall oil as a byproduct of the paper-making process. According to this process, pinewood is digested with alkali and sulfide, producing tall oil soap and crude sulfate turpentine as by-products. Acidification of this soap followed by fractionation of the crude tall oil yields rosin and fatty acid as two of the components. The rosin obtained by this process is known as tall oil rosin (TOR) and the fatty acid obtained by this process is known as tall oil fatty acid (TOFA). The TOFA fraction is composed mainly of $C_{16-18}$ carboxylic acids, which are largely unsaturated in their chain structure. Exemplary tall oil fatty acids include unsaturated acids such as oleic acid, oleic acid isomers, linoleic acid, and linoleic acid isomers, as well as small percentages of saturated fatty acid such as stearic acid.

Due to its high content of unsaturated fatty acid, TOFA may be, and commonly is subjected to acidic clay catalyzed polymerization. In this polymerization process, which is typically conducted at high temperatures, the olefinic fatty acids undergo intermolecular addition reactions by, e.g., the ene-reaction, so as to form polymerized fatty acid. The mechanism of this reaction is very complex and incompletely understood at the present time. However, for purposes of the present invention it will suffice to note that the product of this polymerization process comprises, in large part, dimerized fatty acid and a unique mixture of monomeric fatty acids. This polymerization product is commercially subjected to distillation in order to provide a fraction highly enriched in dimerized fatty acid, which is commonly known in the art as "dimer acid" or "dimer fatty acid". This distillation process will also provide a fraction that is highly enriched in the monomeric fatty acids, where this fraction is commonly known in the art as "monomer" or "monomer acid" or "monomer fatty acid", and will be referred to herein as Monomer.

Monomer is a unique composition. Whereas the natural source-derived TOFA largely consists of linear $C_{18}$ unsaturated carboxylic acids, principally oleic and linoleic acids, Monomer contains relatively small amounts of oleic and linoleic acids, and instead contains significant amounts of branched and cyclic $C_{18}$ acids, both saturated and unsaturated, as well as elaidic acid. The more diverse and significantly branched composition of Monomer results from the catalytic processing carried out on TOFA by the polymerization process just described. The art recognizes that the reaction of Monomer with other chemical substances yields unique, identifiable derivative substances that are chemically different from corresponding TOFA derivatives. Monomer has been assigned CAS Registry Number 68955-98-6. A suitable Monomer for the practice of the present invention is Century MO5® fatty acid as available from Arizona Chemical Company, Jacksonville, Fla.

In one aspect, the present invention is directed to polyol Monomerate. The term polyol Monomerate is used herein to denote a blend of esters, where an ester is generally recognized to include the chemical formula $R^1$—O—C═O—$R^2$, and using this nomenclature $R^1$—O may be referred to as the alcohol portion of the ester while —C═O—$R^2$ may be referred to as the acid portion of the ester. In the polyol Monomerate of the present invention, $R^1$ is the polyol portion while $R^2$ is the Monomer portion. In other words, $R^1$ has the structure of the polyol while $R^2$ has the structure of the Monomer.

An alcohol is an organic compound having at least one hydroxyl (—OH) group. A polyol is an alcohol having two or more, i.e., a plurality of, hydroxyl groups, and according may be denoted as $R^1$—$(OH)_n$, where n denotes the number of hydroxyl groups present in the polyol. In various literatures a polyol is sometimes referred to as a polyhydric compound. According to the present invention, a polyol Monomerate has an $R^1$ group as well as at least one ester group, where each ester group is attached to an $R^2$ group in addition to being attached to the $R^1$ group.

The $R^2$ group of polyol Monomerate is necessarily derived from Monomer. That is, the $R^2$ group will have the structure of the carboxylic acid components of Monomer. The word "Monomer" as used herein begins with a capital letter to denote that it is the material known in the art as "Monomer" rather than being any reactive molecule that might be denoted as lower case "monomer".

As mentioned above, polyol Monomerate contains $R^1$, at least one ester group, and at least one $R^2$ group derived from Monomer. In various aspects of the invention, the $R^1$ group has 2-12 carbons, or 2-6 carbons, or 2 carbons, or 3 carbons, or 4 carbons, or 5 carbons, or 6 carbons. In a preferred aspect, the $R^1$ group contains only carbon and optionally hydrogen, i.e., the $R^1$ group is a hydrocarbyl group. Suitable $R^1$ groups are shown in Table A.

TABLE A

EXEMPLARY $R^1$ GROUPS

2-Carbon $R^1$ groups

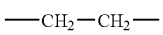

3-Carbon $R^1$ groups

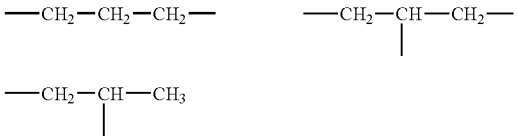

4-Carbon $R^1$ groups

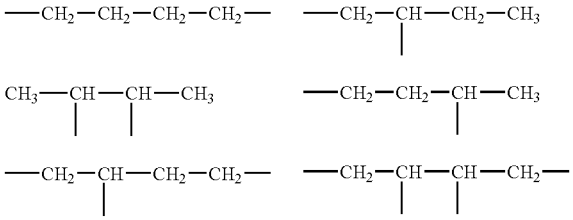

5-Carbon $R^1$ groups

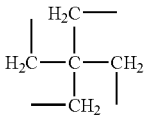

In Table A, "C—" represents a bond from a carbon to either a hydroxyl (—OH) or ester (—O—C═O) group. When a polyol Monomerate has one ester group, that compound is referred to herein as a polyol monoMonomerate. Likewise, when a polyol Monomerate has two ester groups, that compound is referred to herein as a polyol diMonomerate.

While a polyol Monomerate has at least one ester group, it may have zero, one, or more than one hydroxyl groups. For instance, when $R^1$ has the structure:

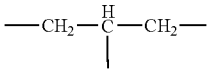

the term polyol Monomerate includes polyol monoMonomerates of either of the following two structures:

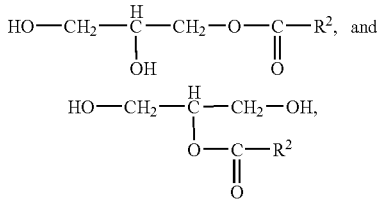

as well as polyol diMonomerates of either of the following two structures:

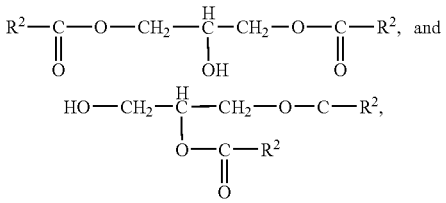

and the polyol triMonomerate of the following structure:

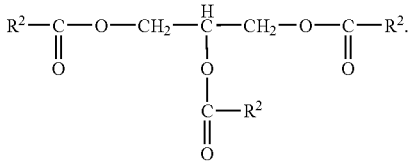

For convenience, the $R^1$ group may be identified herein by naming the polyol from which it may be logically derived. That is, the $R^1$ group can and frequently will be identified by the name of the corresponding polyol having a hydroxyl group at each open position of the $R^1$ group. This nomenclature is illustrated in Table B, which essentially repeats Table A but adds the name of the polyol corresponding to each $R^1$ group.

TABLE B

| NAMES OF EXEMPLARY $R^1$ GROUPS | |
|---|---|
| 2-Carbon $R^1$ groups | |
| $—CH_2—CH_2—$ ethylene glycol | |
| 3-Carbon $R^1$ groups | |
| $—CH_2—CH_2—CH_2—$ 1,3-propanediol | $—CH_2—CH(—)—CH_2—$ glycerol (a.k.a. glycerin) |
| $—CH_2—CH(—)—CH_3$ 1,2-propanediol | |

TABLE B-continued

| NAMES OF EXEMPLARY $R^1$ GROUPS | |
|---|---|
| 4-Carbon $R^1$ groups | |
| $—CH_2—CH_2—CH_2—CH_2—$ 1,4-butanediol | $—CH_2—CH(—)—CH_2—CH_3$ 1,2-butanediol |
| $CH_3—CH(—)—CH(—)—CH_3$ 2,3-butanediol | $—CH_2—CH_2—CH(—)—CH_3$ 1,3-butanediol |
| $—CH_2—CH(—)—CH_2—CH_2—$ 1,2,4-butanetriol | $—CH_2—CH(—)—CH(—)—CH_2—$ 1,2,3,4-butanetetraol |
| 5-Carbon $R^1$ groups | |
| 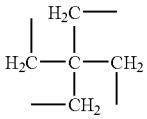 pentaerythritol | |

As mentioned above, the $R^2$ group in a polyol Monomerate is derived from Monomer. Monomer is a commercially available product that includes a variety of organic carboxylic acids. Monomer is typically a mixture of branched-, aromatic-, cyclic-, and straight-chain fatty acids, which may be saturated or unsaturated. The predominant acid in Monomer is "iso-oleic acid", where iso-oleic acid is a mixture of linear, branched and cyclic $C_{18}$ mono-unsaturated fatty acids. The iso-oleic acid may be refined from Monomer by low temperature solvent separation, in order to prepare a purified iso-oleic acid. In one aspect, the polyol Monomerate is prepared from iso-oleic or a blend of acids including iso-oleic, and accordingly may be referred to as polyol iso-oleate.

Thus, the term polyol Monomerate refers to a blend of esters prepared from either Monomer or a by-product of Monomer (e.g., a distillatively-refined Monomer, or an esterification product of Monomer). In one aspect, the $R^2$ groups in polyol Monomerate include at least a cycloaliphatic $C_{17}$ hydrocarbyl group and a branched-chain $C_{17}$ hydrocarbyl group. In another aspect, the $R^2$ groups in polyol Monomerate include at least a cycloaliphatic $C_{17}$ hydrocarbyl group, a branched-chain aliphatic $C_{17}$ hydrocarbyl group, and a straight-chain aliphatic $C_{17}$ hydrocarbyl group. In another aspect, the $R^2$ groups in polyol Monomerate include at least a cycloaliphatic $C_{17}$ hydrocarbyl group, a branched-chain aliphatic $C_{17}$ hydrocarbyl group, a $C_{17}$ hydrocarbyl group including an aromatic ring, and a straight-chain $C_{17}$ hydrocarbyl group. The term "a" as used here and elsewhere in the specification refers to "one or more".

Elaidic acid is one of the fatty acids normally present in Monomer. Accordingly, in one aspect, polyol Monomerate includes a polyol ester of elaidic acid. In various other aspects, the present invention provides glycerol monoelaidate, glycerol dielaidate, and glycerol trielaidate. The elaidic ester will typically not be pure, but will be present in a composition that contains other polyol esters, where this composition will typically be derived from Monomer.

A typical commercially available Monomer has both cyclic and branched $C_{18}$ fatty acids. A typical branched $C_{18}$ fatty acid commonly found in Monomer has the following structure:

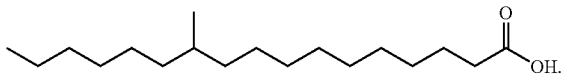

Exemplary cyclic $C_{18}$ fatty acids sometimes found in Monomer have the following structures:

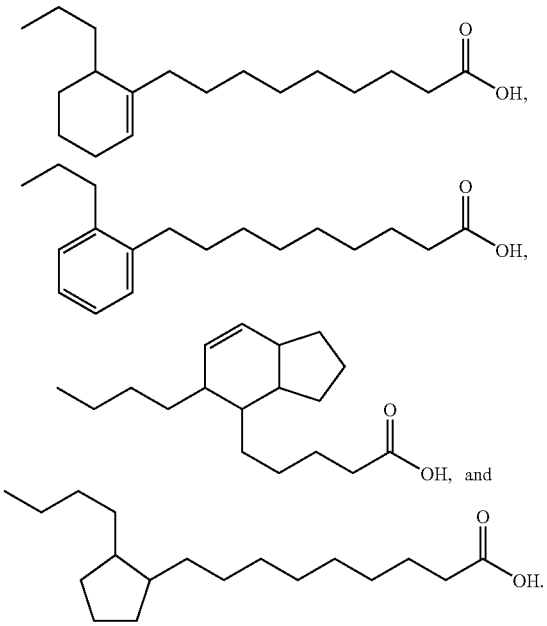

Accordingly, polyol Monomerate denotes a mixture of esters, where this mixture is defined by having acid portions derived from Monomer. In other words, the $R^2$ group in polyol Monomerate actually represents a plurality of hydrocarbyl groups, including both branched and cyclic $C_{17}$ hydrocarbyl groups. In one aspect of the invention, the cyclic $C_{17}$ hydrocarbyl group is unsaturated. In another aspect of the invention, the cyclic $C_{17}$ hydrocarbyl group is a mixture of saturated and unsaturated $C_{17}$ hydrocarbyl groups.

The preparation of the polyol Monomerate of the invention may be accomplished by various means. A straightforward synthetic method is to combine Monomer with a polyol having the desired $R^1$ structure, and then heat these two reactants until polyol Monomerate is formed. This esterification reaction typically requires elevated temperature in the range of 150-250° C. in order to proceed in an economically timely fashion. The progress of the esterification reaction may be readily monitored by pulling a sample and subjecting that sample to acid number analysis. A relatively lower acid number indicates a relatively further degree of esterification, since the acid number is effectively a measure of the amount of unreacted Monomer present in the reaction mixture.

Acid number is measured by dissolving a known weight of sample into an organic solvent (toluene is a typical solvent), and then titrating a measured amount of methanolic potassium hydroxide (KOH) solution into the sample solution. The titration is complete when a pH of about 7 is attained. The acid number of the sample is equal to the amount of KOH, in mg, which was used in the titration, divided by the weight of sample, in grams, that was titrated. In other words, acid number is equal to the mg of KOH needed to neutralize 1 gram of sample.

It is typically the case that not all of the Monomer can be readily converted into an esterified form. Accordingly, the product polyol Monomerate will typically have an acid number of greater than zero. Nevertheless, for performance as a lubricity aid, it is preferred that the acid number of the product mixture be relatively low, typically less than 10, more typically less than 5.

It is also typically the case that not all of the polyol can be readily converted into an esterified form. Residual polyol may be removed from the product mixture by distillation, where the distillation conditions will depend on the identity of the polyol. Polyols with higher boiling points will require more severe distillation conditions, i.e., higher temperature and/or greater vacuum. Residual polyol may also be removed by steam distillation. In one aspect of the invention, the polyol content of a composition including polyol Monomerate is less than 10 weight percent of the composition, while in other aspects the polyol content is less than 8 weight percent, less than 6 weight percent, less than 4 weight percent, less than 2 weight percent, or less than 1 weight percent. Likewise, in one aspect of the invention, the Monomer content of a composition including polyol Monomerate is less than 10 weight percent of the composition, while in other aspects the Monomer content is less than 8 weight percent, less than 6 weight percent, less than 4 weight percent, less than 2 weight percent, or less than 1 weight percent. Additional aspects of the invention provide compositions including polyol Monomerate wherein each of the polyol and Monomer contents of the composition are independently selected from less than 10 weight percent, less than 8 weight percent, less than 6 weight percent, less than 4 weight percent, less than 2 weight percent, and less than 1 weight percent of the composition. In relation to each of these aspects of the invention, the present invention provides additional aspects wherein the polyol and/or Monomer content of the composition is at least 0.1, or 0.5, or 1.0 weight percent of the composition.

To increase the rate of the esterification reaction, a catalyst for esterification reactions may be included in the reactant mixture. Esterification catalysts are well known in the art and include sulfuric acid, phosphoric acid and other inorganic acids, metal hydroxides and, alkoxides such as tin oxide and titanium isopropoxide, and divalent metal salts such as tin or zinc salts. A preferred catalyst is a tin catalyst, e.g., FASCAT 2001® tin catalyst (Atochem, Philadelphia, Pa., USA). When a catalyst is present, it should be used in small amounts, e.g., less than about 5 weight percent of the total mass of the reaction mixture, preferably less than about 2% and more preferably less than about 1% of the total mass of the reaction mixture. Excessive amounts of catalyst increase the cost of preparing the polyol Monomerate, as well as often leave behind residue that may be harmful to the environment in which the ester is located, e.g., an engine.

When polyol and Monomer are reacted together to form polyol Monomerate, a byproduct of this reaction will be water. In order to drive the reaction toward completion, this water should be removed from the reaction or product mixture. In the absence of vacuum or azeotrope formation, a reaction temperature of at least 100° C. is needed in order to distill water away from the reacting components. Thus, at least during the initial stage(s) of ester formation, the reaction temperature is desirably set to about 100-125° C. While a higher initial reaction temperature may be used, the consequence may be water generation at a rate that is greater than water removal may be conveniently accomplished.

In order to drive the reaction to completion, removal of water may be enhanced through addition of an organic solvent that forms a low-boiling azeotrope with water, and/or the addition of a light vacuum on the reaction vessel. To provide a low-boiling azeotrope, an organic solvent that forms an azeotrope with water, e.g., toluene or xylene, can be added to the reaction vessel, and then removed by distillation, under normal pressure.

While the reaction of polyol and Monomer is a convenient approach to preparing polyol Monomerate, variations on this approach may also be used. For example, a transesterification reaction may be used, wherein an ester of Monomer, e.g., the methyl ester, is reacted with a polyol. This approach will produce polyol Monomerate with methanol as a by-product. The methyl ester of Monomer is therefore a reactive equivalent of Monomer in the preparation of polyol Monomerate. The acid chloride form of Monomer is another reactive equivalent of Monomer that could be used to prepare polyol Monomerate, however this would typically raise the cost of preparing the polyol Monomerate, and would also introduce an undesirable by-product (hydrogen chloride). Likewise, an ester of the polyol may be used in lieu of polyol, where acetate ester is a suitable ester, and this ester is a reactive equivalent of the polyol.

Thus, in one aspect, the present invention provides a composition comprising the esterification product of (a) Monomer or a reactive equivalent thereof; and (b) polyol or a reactive equivalent thereof. In a related aspect, the present invention provides a composition comprising the transesterification product of (a) polyol Monomerate; and (b) polyol or a reactive equivalent thereof. In a preferred embodiment, the polyol in these compositions is glycerol.

In additional aspects, the present invention provides polyol Monomerate, which includes one or more of polyol monoMonomerate, polyol diMonomerate, polyol triMonomerate, etc. depending on the functionality of the polyol component. In various embodiments within this aspect of the invention, the polyol may be a diol, e.g., ethylene glycol, 1,2-propylene glycol, 1,3-propylene glycol, 1,2-butylene glycol, 1,3-butylene glycol, 1,4-butanediol, 1,6-hexanediol, neopentyl glycol, and 1,4-cyclohexanedimethanol; or a triol, e.g., glycerin, trimethylolpropane, or tris(hydroxylmethyl) methanol; or a tetraol, e.g., pentaerythritol, or oligomers thereof, e.g., di-pentaerythritol, and tri-pentaerythritol. Each of these polyols may be used in the preparation of a polyol ester of the present invention.

For instance, in one embodiment the present invention provides polyol monoMonomerate, e.g., glycerol monoMonomerate. In another embodiment the present invention provides polyol diMonomerate, e.g., glycerol diMonomerate. In another embodiment the present invention provides a blend that is, or comprises, polyol monoMonomerate and polyol diMonomerate, where the polyol and Monomerate components are the same in the monoMonomerate and the diMonomerate. For instance, the present invention provides a composition that is, or comprises, a blend of glycerol monoMonomerate and glycerol diMonomerate.

For use as a friction modifier in engine oils, it is preferred to use a blend of polyol Monomerates, including both polyol monoMonomerate and polyol diMonomerate. Such a blend is naturally produced when Monomer is reacted with an equal molar amount of polyol. If it is desired to increase the polyol diMonomerate content of a blend, this can be accomplished by increasing the molar ratio of Monomer:polyol in the reaction mixture. In a like manner, increasing the polyol monoMonomerate content of a blend may be achieved by reducing the molar ratio of Monomer:polyol in the reaction mixture. Such a blend may also be produced by reacting a fully esterified polyol Monomerate, e.g., glycerol triMonomerate, with polyol, e.g., glycerol. This transesterification reaction also effectively produces a blend including both polyol monoMonomerate and poly diMonomerate. Other methods of producing polyol esters of fatty acids are described in U.S. Pat. Nos. 3,595,888 and 2,875,221.

As described in detail above, the present invention provides compounds having ester groups (i.e., "esters") wherein the acid portion of the ester group is derived from Monomer and therefore includes both branched $C_{17}$ hydrocarbon and cyclic $C_{17}$ hydrocarbon groups. Straight-chain $C_{17}$ hydrocarbon groups are also typically present. While in one aspect of the invention the branched and cyclic hydrocarbon groups are derived from Monomer, another aspect the present invention provides a blend of polyol esters wherein at least one polyol ester has a branched $C_{12}$-$C_{28}$ hydrocarbyl group in the acid portion of the ester, and at least one polyol ester has a cyclic $C_{12}$-$C_{28}$ hydrocarbyl group in the acid portion of the ester, and the acid portion is not necessarily derived from Monomer. The polyol portion, however, is the same as previously identified in connection with the polyol Monomerate esters.

While Monomer is a convenient source of branched and cyclic fatty acids for use in preparing the ester of the present invention, the zeolite catalyzed process of fatty acid isomerization developed by Kao Corporation (Tokyo, Japan) may also be used to prepare suitable fatty acids. A description of this process may be found in, e.g., JP 6-128193 (Production of Branched Fatty Acids) and JP 5-25108 (Branched Fatty Acids and Production Thereof).

Thus, in one embodiment the present invention provides a mixture of first and second polyol esters, where the first ester has an acid portion that is a $C_{12}$-$C_{28}$ cyclic hydrocarbyl group and the second ester has an acid portion that is a $C_{12}$-$C_{28}$ branched hydrocarbyl group. In one embodiment, the alcohol portion of the first and second esters is identical, while in another embodiment the alcohol portion of the first and second esters is not identical. When the alcohol portions of the first and second esters is not identical, each of the alcohol portions may be selected from, e.g., a diol, e.g., ethylene glycol, 1,2-propylene glycol, 1,3-propylene glycol, 1,2-butylene glycol, 1,3-butylene glycol, 1,4-butanediol, 1,6-hexanediol, neopentyl glycol, and 1,4-cyclohexanedimethanol; or a triol, e.g., glycerin, trimethylolpropane, or tris(hydroxylmethyl)methanol; or a tetraol, e.g., pentaerythritol, or oligomers thereof, e.g., di-pentaerythritol, and tri-pentaerythritol. The first and second esters may be monoesters, diesters, triesters, etc. For instance, in the case where $R^1$ is, at least formally, derived from glycerin, the present invention provides a composition comprising a first ester selected from

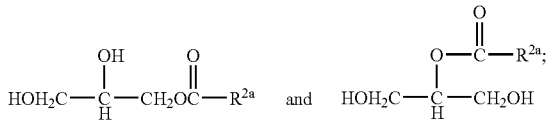

and a second ester selected from

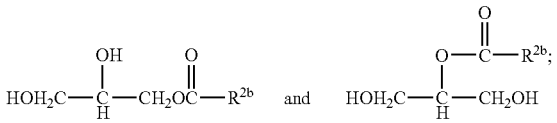

wherein $R^{2a}$ is a branched $C_{12}$-$C_{28}$ hydrocarbon and $R^{2b}$ is a cyclic $C_{12}$-$C_{28}$ hydrocarbon. However, in another aspect, the first ester may be derived, at least formally, from glycerin, while the second ester is, at least formally, derived from pentaerythritol.

In a related aspect, the present invention provides a composition comprising a first component selected from the group consisting of monoester of glycerol and branched $C_{12}$-$C_{28}$ fatty acid, diester of glycerol and branched $C_{12}$-$C_{28}$ fatty acid, and triester of glycerol and branched $C_{12}$-$C_{28}$ fatty acid, and a second component selected from the group consisting of monoester of glycerol and cyclic $C_{12}$-$C_{28}$ fatty acid, diester of glycerol and cyclic $C_{12}$-$C_{28}$ fatty acid, triester of glycerol and cyclic $C_{12}$-$C_{28}$ fatty acid, and glycerol.

Branched and cyclic $C_{12}$-$C_{28}$ fatty acids can be obtained from many sources. For instance, suppliers of fine and bulk chemicals may sell branched and cyclic $C_{12}$-$C_{28}$ fatty acids. See, e.g., Acros Organics (Pittsburgh Pa.), Aldrich Chemical (Milwaukee Wis., including Sigma Chemical and Fluka), Apin Chemicals Ltd. (Milton Park UK), Avocado Research (Lancashire U.K.), BDH Inc. (Toronto, Canada), Bionet (Cornwall, U.K.), Chemservice Inc. (West Chester Pa.), Crescent Chemical Co. (Hauppauge N.Y.), Eastman Organic Chemicals, Eastman Kodak Company (Rochester N.Y.), Fisher Scientific Co. (Pittsburgh Pa.), Fisons Chemicals (Leicestershire UK), Frontier Scientific (Logan Utah), ICN Biomedicals, Inc. (Costa Mesa Calif.), Key Organics (Cornwall U.K.), Lancaster Synthesis (Windham N.H.), Maybridge Chemical Co. Ltd. (Cornwall U.K.), Parish Chemical Co. (Orem Utah), Pfaltz & Bauer, Inc. (Waterbury Conn.), Polyorganix (Houston Tex.), Pierce Chemical Co. (Rockford Ill.), Riedel de Haen AG (Hannover, Germany), Spectrum Quality Product, Inc. (New Brunswick, N.J.), TCI America (Portland Oreg.), Trans World Chemicals, Inc. (Rockville Md.), and Wako Chemicals USA, Inc. (Richmond Va.), to name a few.

The above-listed chemical suppliers may also sell the corresponding alcohols, i.e., compounds of the formula $R^2$—$CH_2$—OH, which can be oxidized to the desired branched or cyclic fatty acid by techniques well known in the art (see, e.g., Fuhrhop, J. and Penzlin G. "Organic Synthesis: Concepts, Methods, Starting Materials", Second, Revised and Enlarged Edition (1994) John Wiley & Sons ISBN: 3-527-29074-5; Hoffman, R. V. "Organic Chemistry, An Intermediate Text" (1996) Oxford University Press, ISBN 0-19-509618-5; Larock, R. C. "Comprehensive Organic Transformations: A Guide to Functional Group Preparations" 2nd Edition (1999) Wiley-VCH, ISBN: 0-471-19031-4; March, J. "Advanced Organic Chemistry: Reactions, Mechanisms, and Structure" 4th Edition (1992) John Wiley & Sons, ISBN: 0-471-60180-2; Patai, S. "Patai's 1992 Guide to the Chemistry of Functional Groups" (1992) Interscience ISBN: 0-471-93022-9; Solomons, T. W. G. "Organic Chemistry" 7th Edition (2000) John Wiley & Sons, ISBN: 0-471-19095-0; Stowell, J. C., "Intermediate Organic Chemistry" 2nd Edition (1993) Wiley-Interscience, ISBN: 0-471-57456-2; "Industrial Organic Chemicals: Starting Materials and Intermediates: An Ullmann's Encyclopedia" (1999) John Wiley & Sons, ISBN: 3-527-29645-X, in 8 volumes; "Organic Reactions" (1942-2000) John Wiley & Sons, in over 55 volumes; and "Chemistry of Functional Groups" John Wiley & Sons, in 73 volumes).

The esters and ester blends of the present invention are useful in admixture with lubricating fluids to improve the friction characteristics of these fluids. Useful lubricating fluids may vary widely and any such fluid can be used in this invention. Illustrative of useful lubricating base fluids are classified in Groups I to V according to American Petroleum Institute (API) and adopted by the lubricant industry. These are Group 1 (sulfur> or =0.03%, saturates< or =90%, viscosity index > or =80 and < or =120) consists of solvent extracted mineral oil, Group II (sulfur < or =0.03%, saturates > or =90%, viscosity index > or =80-< or =120) consists of solvent extracted and hydrofinished mineral oils, Group III (sulfur < or =0.03%, saturates > or =90%, viscosity index > or =120) consists of hydrocracked mineral oils, Group IV (Polyalphaolefin, PAO) and Group V (everything that is not included in Groups 1-V): these include esters, alkylated aromatics, and silicones.

The esters and ester blends of the present invention are preferably used to improve the friction characteristics of engine oils. As a primary function of engine oil is to provide lubricity between engine parts where at least one of those engine parts is moving during engine operation, the engine oil should be an oil of lubricating viscosity. The engine oil may be, or include, natural or synthetic oils and mixtures thereof. Natural oils include animal oils, vegetable oils, mineral lubricating oils, solvent or acid treated mineral oils, and oils derived from coal or shale. Synthetic oils include alkylated aromatics, hydrocarbon oils, halo substituted hydrocarbon oils, alkylene oxide polymers, esters of dicarboxylic acids and polyols, esters of phosphorus containing acids, polyisobutylenes, polymeric tetrahydrofurans and silicon based oils. A typical automotive engine oil consists of:

Base Oil (74%)
Phosphorous based Antiwear Agent (1%)
Zinc Dialkyldithiophosphate Extreme Pressure Agent (1.3%)
Arylamine and Phenolic Antioxidants (1.5%)
Polyisobutylene succinimide Dispersant (18%)
Sulfonate Detergent (5.5%)
Phosphate Amine Antirust Agent (0.5%)
Polymethylmethacrylate Viscosity Index Improver (1.15%)
Silicone Defoamer (0.05%)
GMM 1%

The esters and ester blends of the present invention are also preferably used to improve the friction characteristics of lubricating fluids used in metal working fluids where a primary function of the metal working fluid is to provide lubricity between the metal being worked and the machine tool. Lubricating base fluids used as metal working fluids include but are not limited to mineral oil, esters and polyalkylene glycols. A typical metal working formulation that uses GMM will consist of:

| | |
|---|---|
| Mineral Oil | 68% |
| Sulfonate | 7% |
| Distilled tall oil | 10% |
| Triethanolamine | 2.5% |
| Ethoxylated Castor Oil | 6.5% |
| Emulsifier | 2.5% |
| GMM | 3% |

In addition to an ester or ester blend of the present invention, the lubricating fluid may contain one or more additives. Additives are often included in lubricating fluids, and accordingly one of ordinary skill in the art is well aware of such additives that include but are not limited to antiwear agents, extreme pressure agents, antioxidants, dispersants, detergents, antirust agents, viscosity index improvers and defoamers. These additives may be included in lubricating fluid formulations of the present invention in their usual amounts, i.e., the amounts in which they are used in compositions that do not include the polyol esters of the present invention, where these additives will provide their usual properties. Exemplary additives include:

Imidazolines, such as 2-methylimidazoline, and polyalkyl amines, such as are disclosed in U.S. Pat. No. 4,713,188;

Polyisobutylene having a number average molecular weight from 400 to 2500, preferably about 950. Polyisobutylene acts to improve lubricity and anti-scuff activity of the lubricant;

Functionalized polyisobutylene having a number average molecular weight from 400 to 2500, preferably about 1300. The functional group for the olefin is typically amine based. This functionalized polyisobutylene is present in an amount up to 15% by weight, preferably up to 10%, more preferably about 5%, by weight. The functionalized polyisobutylene is therefore, a reaction product of the olefin and olefin polymers with amines (mono-or-polyamines). The functionalized polyisobutylene provides superior detergency performance, particularly in two-stroke cycle engines;

Auxiliary extreme pressure agents and corrosion and oxidation inhibiting agents such as a chlorinated aliphatic hydrocarbon, e.g., chlorinated wax and chlorinated aromatic compounds; organic sulfides and polysulfides; sulfurized alkylphenol; phosphosulfurized hydrocarbons; phosphorus esters; including principally dihydrocarbon and trihydrocarbon phosphites, and metal thiocarbamates. Many of the these auxiliary extreme pressure agents and corrosion oxidation inhibitors also serve as antiwear agents. Zinc dialkylphosphorodithioates are a well known example;

Pour point depressants, which serve to improve low temperature properties of lubricating fluid based compositions. Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715; and Anti foam agents, which function to reduce or prevent the formation of stable foam. Typical anti foam agents include silicones or organic polymers.

The polyol esters, including the polyol Monomerate of the present invention may be included in an engine oil composition at a concentration of about 0.1% to 10% by weight of the composition, where a concentration of about 0.5% to 2% by weight is typically optimal. The oil may be formulated for 2-cycle engines or 4-cycle engines. The oil may be formulated for a gasoline-powered engine, a jet-fuel powered engine, or a diesel fuel powered engine, to name a few.

While the oil is preferably a lubricating oil, the esters of the present invention may also be used in combination with any other oil where it is desired to improve the friction characteristics of the oil. Such oils include, without limitation, automatic transmission fluid (ATF), cylinder lubricant, crankcase lubricating oil, functional fluid, such as a power transmission fluid where an exemplary power transmission fluid is hydraulic fluid and hydraulic oil, tractor oil, gear oil, and metal working oil. In these oils, the ester of compositions of the present invention may be present in the composition at an amount effective to improve the friction characteristics of the composition, e.g., the coefficient of friction of the composition.

In one aspect, the esters and ester blends of the present invention are useful as lubricity additives in fuel. The fuel preferably has a low sulfur content. The burning of sulfur-containing fuel produces sulfur dioxide as a by-product, where sulfur dioxide has recently come under intense scrutiny for causing environmental damage. Diesel fuels in particular tend to have relatively high sulfur contents. A typical diesel fuel in the past contained 1% by weight or more of sulfur (expressed as elemental sulfur). Today, it is considered desirable to reduce the level to 0.2% by weight, preferably to 0.05% by weight and, advantageously, to less than 0.01% by weight, particularly less than 0.001% by weight. The production of these low sulfur fuels achieves, as an undesirable result, a decrease in the natural components of a fuel that provide lubricity to the fuel. Poor lubricity can lead to wear problems in mechanical devices dependent for lubrication on the natural lubricity of fuel oil. Accordingly, there is a need in the art for lubricity additives, i.e., materials that will increase the lubricity of the fuel into which the additive is placed. The present invention provides such a lubricity enhancer in the esters and ester blends described herein.

While the fuel is preferably a diesel fuel, it is true that gasoline fuels are also becoming subject to compositional constraints, including restrictions on sulfur content, in an effort to reduce pollutants. The principal concern is the effect of sulfur on exhaust catalyst life and performance. The lubricity requirements of gasoline are somewhat lower than for diesel fuel since the majority of gasoline fuel injection systems inject fuel upstream of the inlet valves and thus operate at much lower pressures than diesel fuel pumps. However, as automobile manufacturers desire to have electrically powered fuel pumps within the fuel tanks, failure of the pumps can be expensive to repair. These problems are also likely to increase as injection systems become, more sophisticated and the gasoline fuels become more highly refined.

Accordingly, the present invention provides a fuel composition having improved lubricity, where the fuel composition is the combination of ingredients comprising gasoline and the ester or ester blends as described herein. In one aspect, the present invention provides a fuel composition comprising a major amount of a fuel, where the fuel has a sulfur content of less than 0.2% by weight, preferably less than 0.05% by weight, more preferably less than 0.01% by weight, particularly less than 0.001% by weight, and aminor amount of the ester or ester bend as described herein, the ester or ester blend being effective to reduce the wear rate of an engine, particularly a diesel engine injection system, which operates with the fuel composition. In a related aspect, the present invention provides a fuel composition comprising a distillate fuel having a sulfur content less than 0.05% by weight and from 1 to 10,000 ppm of an ester or ester blend of the present invention. Analogously, the present invention provides a method of reducing the wear properties of a fuel, where the method comprises combing fuel and the ester or ester blend of the present invention, in relative amounts such that the combination has superior wear properties compared to the fuel without the ester or ester blend. Thus, the present invention provides a method for improving the lubricity of a distillate fuel having a sulfur content of less than 0.05% by weight, comprising the addition thereto of the ester or ester blend of the present invention.

The fuel compositions of the present invention may contain supplemental additives in addition to the esters and ester blends as described herein. These supplemental additives include, without limitation, supplemental dispersant/detergents, cetane improvers, octane improvers, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, other lubricity additives and combustion improvers.

The base fuels used in formulation a fuel composition of the present invention include any base fuels suitable for use in the operation of spark-ignition or compression-ignition internal combustion engines such as diesel fuel, jet fuel, kerosene, leaded or unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the present invention include methanol, ethanol, iso-propanol, t-butanol, mixed $C_1$ to $C_5$ alcohols, methyl tertiary butyl ether, tertiary amyl methyl ether, ethyl tertiary butyl ether and mixed ethers. Oxygenates, when used, will normally be present in the base fuel in an amount below about 25% by volume, and preferably in an amount that provides an oxygen content in the overall fuel in the range of about 0.5 to about 5 percent by volume.

The present invention will now be illustrated by the following Example, which is exemplary of the invention and not to be construed as a limitation thereon. This Example illustrates the synthesis and performance properties of a polyol ester of the present invention, and additionally compares these performance properties to the properties of a commercially successful polyol ester, i.e., glycerol monooleate (GMM), that is used in engine oils.

EXAMPLE I

Monomer (CENTURY MO5® fatty acid from Arizona Chemical, Jacksonville, Fla., USA; 1,390 g, 77.2 wt %) and glycerol (410 g, 22.8 wt %) were combined in a four-necked round-bottomed flask under a nitrogen atmosphere, where the flask was equipped with a mechanical stirrer, temperature probe, and a Dean Stark trap. The flask contents were stirred and heated to a temperature of 200° C. for 7.5 hours with concomitant removal of water, at which point the reaction mixture had an acid value below 6.5. Vacuum (5 mm Hg) was applied to the reaction mixture to remove volatiles, including water and excess glycerol, leaving a product termed GMM having a glycerol content of less than 1 wt %, based on the weight of the GMM. GMM had an acid value of 2.2, a Gardner color of 5+, a viscosity at 40° C. of 163.6 cSt, a viscosity at 100° C. of 138 cSt, and contained glycerol monoMonomerate and glycerol diMonomerate in an approximately 1:1 weight ratio.

EXAMPLE II

Blends of GMM and automatic transmission fuel (ATF, composition set forth at the end of this example) were prepared having 0.5 wt % and 1.0 wt % GMM. For comparison, glycerol monooleate (GMO) was also added to ATF at 0.5 wt % and 1 wt % levels. GMO is a friction modifier that sees considerable industrial use, and was used to compare the performance of GMM. These blends were evaluated as follows:

The friction coefficient of each blend was determined in comparison to neat ATF, using the ring-on-disk procedure. The results are set forth in Table 1, where it can be seen that the addition of 0.5 wt % GMO raised the friction coefficient (relative to ATF alone) by 21%. In general, a lower friction coefficient is desirable. In contrast, GMM actually lowered the friction coefficient, and by the considerable amount of 26%.

TABLE 1

FRICTION COEFFICIENT MEASUREMENT

| | ATF alone | ATF + 0.5% GMM | ATF + 0.5% GMO |
|---|---|---|---|
| Friction Coefficient | 0.019 | 0.014 | 0.023 |
| % Difference | N/A | −26% | +21% |

Additional comparative performance data regarding modification of lubricity properties of a base oil were obtained following ASTM D2670, with the results shown in Table 2. Under the conditions of ASTM D2670, the addition of 0.5 wt % GMO to ATF did not change the friction performance of ATF. However, when 0.5 wt % GMM was added to ATF, the blend afforded a very desirable 60% smaller wear scar compared to either ATF alone or ATF with 0.5 wt % GMO.

TABLE 2

WEAR SCAR MEASUREMENT BY ASTM D2670

| | Wear Scar (μm) | % Change |
|---|---|---|
| ATF (pure) | 0.0005 | N/A |
| ATF + 0.5% GMO | 0.0005 | 0 |
| ATF + 0.5% GMM | 0.0002 | 60 |

Further performance data about the ability of the ester of the present invention to improve the friction properties of a lubricant was obtained by performing a high frequency reciprocating rig (HFRR) test. Blends having 1 wt % of GMM or GMO in neat base oil (NBO) were tested and compared with neat base oil. The NBO was a hydrotreated high viscosity petroleum-derived oil known as CIT85® oil (CITGO, Tulsa, Okla., USA; @citgo.com). The results are set forth in Table 3, where it can be seen that the addition of 1 wt % GMM lowered the friction coefficient (relative to base oil alone, i.e., neat base oil) from 0.171 to 0.097, while the same weight of GMO was able to lower the friction coefficient of neat base oil by a somewhat lesser amount to 0.099.

TABLE 3

| FRICTION COEFFICIENT MEASUREMENT BY HFRR | | |
|---|---|---|
| | Wear Scar (μm) | Friction Coefficient |
| NBO | 354.3 | 0.171 |
| NBO + 0.5% GMO | 157.6 | 0.099 |
| NBO + 0.5% GMM | 107.4 | 0.097 |

The automatic transmission fluid (ATF) used in the compositions characterized in Tables 2 and 3 contained (on a weight percent basis): 91.8% base oil, 0.5% phenolic antioxidant, 0.5% arylamine antioxidant, 2.0% dispersant, 0.1% metal deactivator, 2.5% gear oil package, 0.1% rust inhibitor, 2.0% viscosity index improver, with 0.5% or 1% left for the friction modifier.

EXAMPLE III

The effect of the addition of 0.1% by wgt of GMM and GMO as friction modifiers was evaluated for an automotive engine oil using the Ring on Disk test at 100° C. using the procedure of EXAMPLE II. The engine oil, identified in the Example as Engine Oil B, had the following composition:

Composition of Engine Oil B

Paraffinic Mineral Oil (72% by wgt.)
Phophorous Based Antiwear Agent (1% by wgt.)
Zinc Dialkyldiphosphate Extreme Pressure Agent (1.3% by wgt.)
Arylamine and Phenolic Antioxidants (1.5% by wgt.)
Polyisobutylene succinimide Dispersant (18% by wgt.)
Sulfonate Detergent (5.5% by wgt.)
Phosphate Amine Antirust Agent (0.5% by wgt.)
Polymethylmethacrylate Viscosity Index Improver (1.15% by wgt.)
Silicone Defoamant (0.05% by wgt.)

The results are set forth in the following Tables 4.

TABLE 4

| FRICTION COEFFICIENT MEASUREMENT | | | |
|---|---|---|---|
| Value | Engine Oil B alone | Engine Oil B + 0.1% GMM | Engine Oil B + 0.1% GMO |
| Friction Coefficient | 0.107 | 0.106 | 0.116 |
| % Difference | N/A | −.9% | +8.4% |

The results set forth in Table 4 show that the addition of 0.1 wt % GMO raised the friction coefficient (relative to Engine Oil B alone) by 8.4%. In general, a lower friction coefficient is desirable. In contrast, GMM actually lowered the friction coefficient by 0.9%.

EXAMPLE IV

The effect of the addition of 0.1% by wgt. of GMM and CMO as friction modifiers was evaluated at 100° C. and ambient temperature for an industrial gear oil formulation using the Ring on Disk test and a high frequency reciprocating rig (HFRR) test using the procedure of EXAMPLE II. The industrial gear oil formulation, identified as Gear Oil C, had the following composition:

Composition of Gear Oil C

PAO 40/Ester Base Fluid (96% by wgt.)
Arylamine and Phenolic Antioxidants (1.5% by wgt.)
Mobilad G305 Gear Oil Additive Package (2.3% by wgt.)
Silicon Defoamant (0.05% by wgt.)
Polyisobutylene Viscosity Index Improver (0.15% by wgt.)

The results of the Ring-on-Disk test at ambient temperature are set forth in the following Table 5.

TABLE 5

| FRICTION COEFFICIENT MEASUREMENT @ AMBIENT TEMPERATURE | | | |
|---|---|---|---|
| Value | Gear Oil C alone | Gear Oil C + 0.1% GMM | Gear Oil C + 0.1% GMO |
| Friction Coefficient | 0.051 | 0.035 | 0.038 |
| % Difference | N/A | −31.37% | −25.49% |

The results set forth in Table 5 show that the addition of 0.1 wt % GMO lowered the friction coefficient at ambient temperature (relative to Gear Oil C alone) by 25.49% while addition of 0.1 wt % GMO lowered the friction coefficient at ambient temperature by 31.37%.

The results of the Ring on Disk test at 100° C. are set forth in the following Table 5.

TABLE 6

| FRICTION COEFFICIENT MEASUREMENT @ AT 100° C. | | | |
|---|---|---|---|
| Value | Engine Oil C alone | Engine Oil C + 0.1% GMM | Engine Oil C + 0.1% GMO |
| Friction Coefficient | 0.076 | 0.021 | 0.044 |
| % Difference | N/A | −72.37% | −42.10% |

The results set forth in Table 6 show that the addition of 0.1 wt % GMO lowered the friction coefficient at ambient temperature (relative to Gear Oil C alone) by 42.10% while addition of 0.1 wt % GMO lowered the friction coefficient at ambient temperature by 72.37%.

The results of the high frequency reciprocating rig (HFRR) test are set forth in the following Table 7.

TABLE 7

| FRICTION COEFFICIENT MEASUREMENT BY HFRR | | | |
|---|---|---|---|
| | Wear Scar (μm) | Friction Coefficient | Film, % |
| Gear Oil C | 183 | 0.076 | 98 |
| Gear Oil C + 0.5% GMO | 166 | 0.076 | 96 |
| Gear Oil C + 0.5% GMM | 161 | 0.075 | 98 |

The results set forth in Table 7 show that the addition of 0.1 wt % GMM lowered the friction coefficient and the Wear Scar (relative to Gear Oil C alone) to a greater extent than the addition of 0.1 wt % GMO. All of the above U.S. patents, U.S. patent application publications, U.S. patent applications, foreign patents, foreign patent applications and non-patent publications referred to in this specification and/or listed in the Application Data Sheet are incorporated herein by reference, in their entirety.

From the foregoing it will be appreciated that, although specific embodiments of the invention have been described herein for purposes of illustration, various modifications may be made without deviating from the spirit and scope of the invention.

The invention claimed is:

1. A lubricating composition, comprising a lubricating fluid; and polyol Monomerate, wherein the composition is a lubricating oil.

2. The lubricating composition according to claim 1, wherein the polyol Monomerate is glycerol Monomerate.

3. The lubricating composition according to claim 1, wherein the polyol Monomerate has an acid number of greater than zero.

4. The lubricating composition according to claim 1, wherein the polyol Monomerate has an acid number of greater than zero.

5. The lubricating composition according to claim 1, wherein the polyol Monomerate is a polyol monoMonomerate.

6. The fuel composition according to claim 5, wherein the polyol monoMonomerate is glycerol monoMonomerate.

7. The lubricating composition according to claim 1, wherein the polyol Monomerate is a polyol diMonomerate.

8. A fuel composition comprising a distillate fuel having a sulfur content less than 0.05% by weight; and from 1 to 10,000 ppm of polyol Monomerate.

9. The fuel composition of claim 8 wherein the fuel composition is a diesel fuel composition.

10. The fuel composition according to claim 8, further comprising a sulfur content of less than 0.05% by weight.

11. The fuel composition according to claim 8, wherein the polyol Monomerate is glycerol Monomerate.

12. The fuel composition according to claim 8, wherein the polyol Monomerate has an acid number of greater than zero.

13. The fuel composition according to claim 8, wherein the polyol Monomerate has an acid number of less than 10.

14. The fuel composition according to claim 8, wherein the polyol Monomerate is a polyol monoMonomerate.

15. The fuel composition according to claim 8, wherein the polyol Monomerate is a polyol monoMonomerate.

16. A method for improving the lubricity of a distillate fuel having a sulfur content of less than 0.05% by weight, comprising the addition thereto of polyol Monomerate.

17. A lubricating composition, comprising a lubricating fluid; and an esterification product of: a) Monomer or a reactive equivalent thereof; and b) polyol or a reactive equivalent thereof, wherein the composition is a lubricating oil.

18. The lubricating composition according to claim 17, wherein the b) polyol or reactive equivalent thereof is at least one member selected from the group consisting of a diol, triol, and tetraol.

19. The lubricating composition according to claim 17, wherein the b) polyol or reactive equivalent thereof is at least one member selected from the group consisting of glycerol, ethylene glycol, 1,2-propylene glycol, 1,3-propylene glycol, 1,2-butylene glycol, 1,3-butylene glycol, 1,4-butanediol, 1,6-hexanediol, neopentyl glycol, 1,4-cyclohexanedimethanol, glycerin, trimethyloipropane, tris(hydroxylmethyl)methanol, pentaerythritol, di-pentaerythritol, and tri-pentaerythritol.

20. The lubricating composition according to claim 17, wherein the esterification product has an acid number of greater than zero.

21. The lubricating composition according to claim 17, wherein the esterification product has an acid number of less than 10.

22. A fuel composition, comprising a distillate fuel having a sulfur content less than 0.05% by weight; and from 1 to 10,000 ppm of an esterification product of: a) Monomer or a reactive equivalent thereof; and b) polyol or a reactive equivalent thereof.

23. The fuel composition of claim 22 wherein the fuel composition is a diesel fuel composition.

24. The fuel composition according to claim 22, further comprising a sulfur content of less than 0.05% by weight.

25. The fuel composition according to claim 22, wherein the b) polyol or reactive equivalent thereof is at least one member selected from the group consisting of a diol, triol, and tetraol.

26. The fuel composition according to claim 22, wherein the b) polyol or reactive equivalent thereof is at least one member selected from the group consisting of glycerol, ethylene glycol, 1,2-propylene glycol, 1,3-propylene glycol, 1,2-butylene glycol, 1,3-butylene glycol, 1,4-butanediol, 1,6-hexanediol, neopentyl glycol, 1,4-cyclohexanedimethanol, glycerin, trimethylolpropane, tris(hydroxylmethyl) methanol, pentaerythritol, di-pentaerythritol, and tri-pentaerythritol.

27. The fuel composition according to claim 22, wherein the esterification product has an acid number of greater than zero.

28. The fuel composition according to claim 22, wherein the esterification product has an acid number of less than 10.

29. A lubricating composition, comprising a lubricatina fluid; and an esterification product of: a) a $C_{12}$-$C_{28}$ cyclic fatty acid or reactive equivalent thereof; b) a $C_{12}$-$C_{28}$ branched fatty acid or reactive equivalent thereof; and c) one or more polyols or reactive equivalents thereof, wherein the composition is a lubricating oil.

30. The lubricating composition according to claim 29, wherein the c) one or more polyols or reactive equivalents thereof is at least one member selected from the group consisting of glycerol and pentaerythritol.

31. The lubricating composition according to claim 29, wherein the esterification product has an acid number of greater than zero.

32. The lubricating composition according to claim 29, wherein the esterification product has an acid number of less than 10.

33. The lubricating composition according to claim 32, wherein the polyol monoMonomerate is glycerol monoMonomerate.

34. A fuel composition, comprising a distillate fuel having a sulfur content less than 0.05% by weight; and from 1 to 10,000 ppm of an esterification product of: a) a $C_{12}$-$C_{28}$ cyclic fatty acid or reactive equivalent thereof; b) a $C_{12}$-$C_{28}$ branched fatty acid or reactive equivalent thereof; and c) one or more polyols or reactive equivalents thereof.

35. The fuel composition of claim 34 wherein the fuel composition is a diesel fuel composition.

36. The fuel composition according to claim 34, further comprising a sulfur content of less than 0.05% by weight.

37. The fuel composition according to claim 34, wherein the c) one or more polyols or reactive equivalents thereof is at least one member selected from the group consisting of glycerol and pentaerythritol.

38. The fuel composition according to claim 34, wherein the esterification product has an acid number of greater than zero.

39. The fuel composition according to claim 34, wherein the esterification product has an acid number of less than 10.

40. A lubricating composition, comprising a lubricating fluid; and a first ester selected from

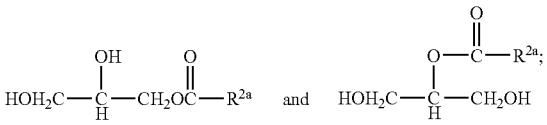

and a second ester selected from

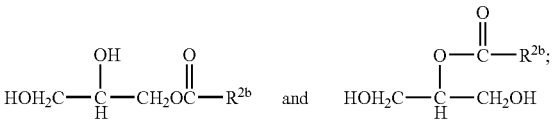

wherein $R^{2a}$ is a branched $C_{12}$-$C_{28}$ hydrocarbon and $R^{2b}$ is a cyclic $C_{12}$-$C_{28}$ hydrocarbon, and wherein the composition is a lubricating oil.

41. A fuel composition, comprising a distillate fuel having a sulfur content less than 0.05% by weight; and from 1 to 10,000 ppm of a first ester selected from

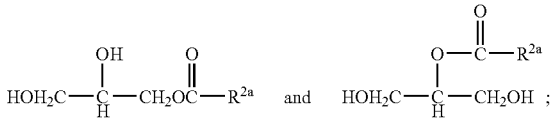

and a second ester selected from

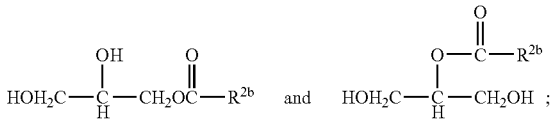

wherein $R^{2a}$ is a branched $C_{12}$-$C_{28}$ hydrocarbon and $R^{2b}$ is a cyclic $C_{12}$-$C_{28}$ hydrocarbon.

42. The fuel composition of claim 41 wherein the fuel composition is a diesel fuel composition.

43. The fuel composition according to claim 41, further comprising a sulfur content of less than 0.05% by weight.

* * * * *